US006961001B1

(12) United States Patent
Chang et al.

(10) Patent No.: US 6,961,001 B1
(45) Date of Patent: Nov. 1, 2005

(54) PERIMETER MONITORING ALARM METHOD AND SYSTEM

(75) Inventors: E-Lee Chang, Mableton, GA (US); Linda A. Roberts, Decatur, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 10 days.

(21) Appl. No.: 10/112,688

(22) Filed: Mar. 29, 2002

(51) Int. Cl.[7] ..... G08B 23/00

(52) U.S. Cl. ..... 340/573.4; 340/691.3; 340/589.1; 340/539.15

(58) Field of Search ..... 340/573.4, 691.3, 340/568.1, 572.1, 571, 539.1, 539.15; 455/404.1

(56) References Cited

U.S. PATENT DOCUMENTS

| | | | | | |
|---|---|---|---|---|---|
| 5,337,041 | A | * | 8/1994 | Friedman | 340/573 |
| 5,731,757 | A | | 3/1998 | Layson, Jr. | 340/573 |
| 5,742,233 | A | | 4/1998 | Hoffman et al. | 340/573 |
| 5,771,001 | A | | 6/1998 | Cobb | 340/573 |
| 5,777,580 | A | | 7/1998 | Janky et al. | 342/457 |
| 5,850,196 | A | | 12/1998 | Mowers | 342/357 |
| 5,905,461 | A | * | 5/1999 | Neher | 342/537 |
| 5,939,981 | A | | 8/1999 | Renney | 340/539 |
| 5,959,529 | A | | 9/1999 | Kail, IV | 340/539 |
| 6,072,396 | A | | 6/2000 | Gaukel | 340/573.4 |
| 6,084,517 | A | * | 7/2000 | Rabanne | 340/573.4 |
| 6,317,049 | B1 | | 11/2001 | Toubia et al. | 340/573.4 |
| 6,362,778 | B2 | | 3/2002 | Neher | 342/357.07 |
| 6,396,403 | B1 | * | 5/2002 | Haner | 340/573.4 |
| 6,611,739 | B1 | | 8/2003 | Harvey et al. | 701/29 |
| 6,696,982 | B2 | | 2/2004 | Yoshioka et al. | 340/988 |
| 2002/0115436 | A1 | | 8/2002 | Howell et al. | 455/426 |
| 2003/0120395 | A1 | | 6/2003 | Kacel | 701/1 |
| 2003/0139179 | A1 | | 7/2003 | Fuchs et al. | 455/426 |

OTHER PUBLICATIONS

U.S. Appl. No. 10/185,301, filed Jun. 28, 2002, entitled "Monitoring System for Persons, Vehicles, Equipment and Miscellaneous Items", Inventors: Dennis et al.

Official Action Issued by USPTO dated Nov. 18, 2004 in connection with Ser. No. 10/185,301 (13 pages).

* cited by examiner

*Primary Examiner*—Anh V. La
(74) *Attorney, Agent, or Firm*—Merchant & Gould

(57) ABSTRACT

A system and method are provided for monitoring the location of a person, pet, or inanimate object relative to the location of a monitoring device. If the person, pet, or inanimate object ("monitored object") travels from or is taken from a specified monitoring perimeter, for example 50 meters, an alarm is activated at the monitoring device to notify the guardian of the monitored object that the monitored object has moved beyond the specified perimeter. A signaling device is attached to the monitored object for signaling its location to the base station. A device for establishing the precise location of the signaling device relative to the base station are provided. If the monitored object becomes lost from the control of the guardian, devices are provided for identifying the monitored object from information stored in a distributed computing network, and devices are provided for contacting the guardian of the monitored object at the monitoring device.

38 Claims, 3 Drawing Sheets

PERIMETER MONITORING ALARM METHOD AND SYSTEM

FIELD OF THE INVENTION

This invention relates to a system and method for monitoring the distance and location of a person, animal, or object from the location of a designated base station.

BACKGROUND OF THE INVENTION

Guardians of children and elderly persons, pet owners, and owners of easily lost or stolen objects often find that keeping track of children, elderly persons, pets, and valuable objects can be difficult without constant supervision. For example, a parent takes her child on a picnic, and while the parent is preparing a meal, the child runs from the parent's area of immediate supervision causing the parent to panic upon realizing the child has left the area. Likewise, a pet owner may take a pet to an area such as a beach or playground to allow the pet to play only to find that the pet runs from the area within the view of the pet owner. A valuable object such as a purse or briefcase may be misplaced, or those objects may be stolen from the owner and removed from the owner's control.

Accordingly, there is need in the art for a system and method for establishing a perimeter within which a monitored person or object may travel or be taken such that if the person or object travels or is taken outside the monitored perimeter, a monitoring device operated by the guardian of the person or owner of the object will alarm to notify the guardian or owner that the person or object has traveled or has been taken outside the monitored perimeter.

SUMMARY OF THE INVENTION

In accordance with the present invention, the above and other problems are solved by a system and method for monitoring the location of a person, pet, or inanimate object relative to the location of a monitoring device. If the person, pet, or inanimate object ("monitored object") travels from or is taken from a specified monitoring perimeter, for example 50 meters, an alarm is activated at the monitoring device to notify the guardian of the monitored object that the monitored object has moved beyond the specified perimeter. A signaling device is attached to the monitored object for signaling its location to the base station. Means for establishing the precise location of the signaling device relative to the base station are provided. If the monitored object becomes lost from the control of the guardian, means are provided for identifying the monitored object from information stored in a distributed computing network, and means are provided for contacting the guardian of the monitored object at the monitoring device.

These and other features and advantages, which characterize the present invention, will be apparent from a reading of the following detailed description and a review of the associated drawings. It is to be understood that both the foregoing general description and the following detailed description are exemplary and explanatory only and are not restrictive of the invention, as claimed.

DETAILED DESCRIPTION OF THE PREFERRED EMBODIMENT

Figure 1:
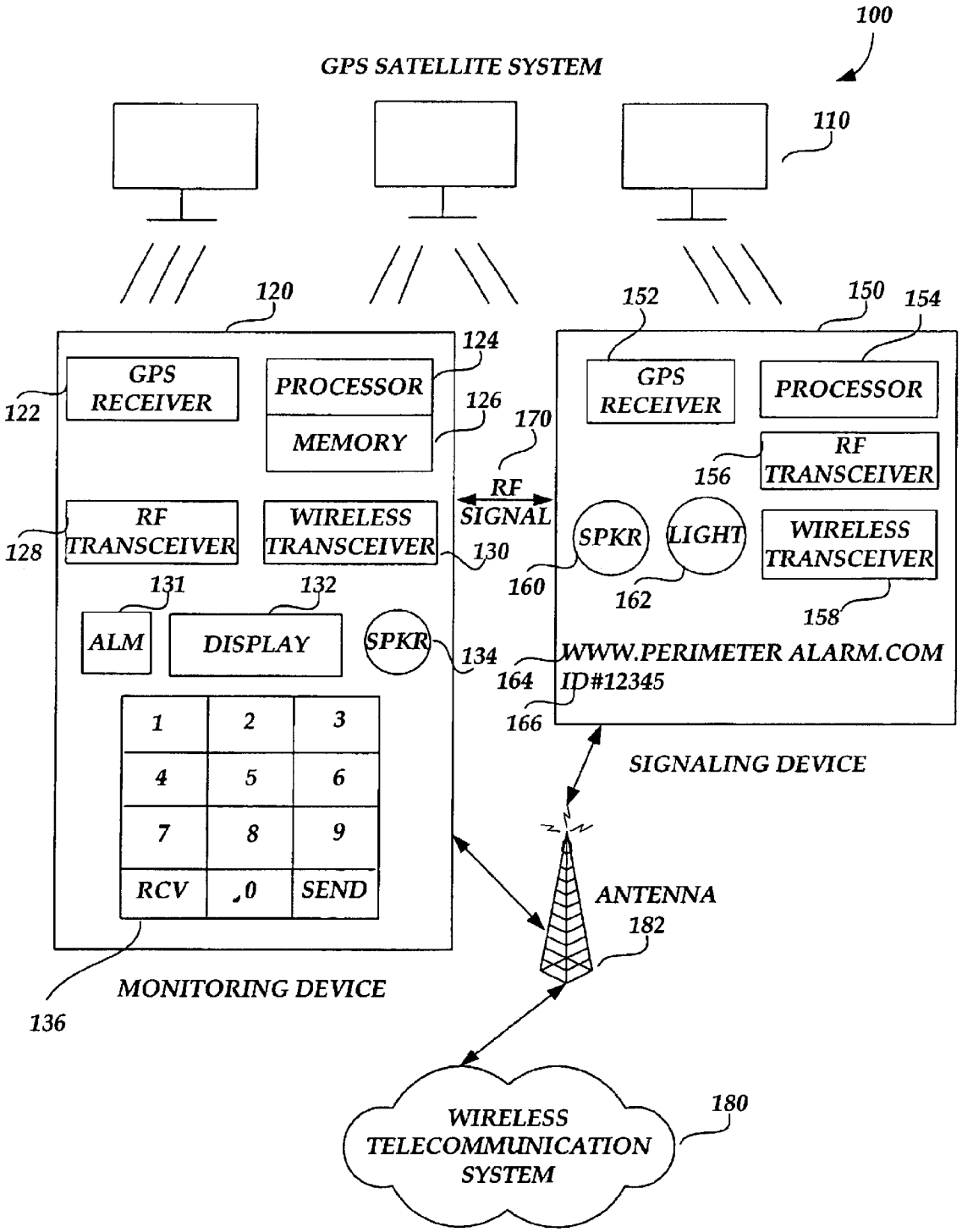
FIG. 1 is a block diagram illustrating some of the components of an exemplary system architecture for the perimeter monitoring alarm system of the present invention.

The following description of an exemplary embodiment of the present invention is made with reference to the above-described drawings wherein like numerals refer to like parts or components throughout the several figures. Referring now to FIG. 1, a perimeter monitoring alarm system 100 according to the present invention is illustrated. A monitoring device 120 serves as a base station for monitoring the location of a monitored object such as a person, pet, or inanimate object. The monitoring device 120 includes a global positioning satellite (GPS) receiver 122, a radio frequency (RF) receiver 128, and a wireless telecommunications transceiver 130. A processor 124 and memory 126 are provided for processing and storing incoming and outgoing data received by and transmitted from the monitoring device 120. A display 132 is provided for displaying the distance of the monitored object from the monitoring device. An alarm button 131 is located adjacent to the display 132 for presenting an alarm tone or alarm light at the signaling device 150. A keypad 136 is provided for inputting data such as the distance from the monitoring device in which the monitored object will be monitored.

The monitoring device 120 also includes a speaker 134 for presenting audible alarms and communications from the signaling device 150, described below. In addition, the monitoring device 120 may be equipped with a tactile alarm system, including a vibration unit located inside the monitoring device 120 for presenting a vibratory tactile sensation to the guardian as an alternative to the speaker 134. Alternatively, the monitoring device 120 may include a light (not shown) for presenting a visual alarm to the guardian. Use of a tactile alarm system or a visual alarm system is advantageous for use by hearing or seeing impaired guardians.

A signaling device for attachment to the monitored object is illustrated in FIG. 1. The signaling device 150 includes a GPS receiver 152, a processor 154, an RF transceiver 156 and a wireless telecommunications transceiver 158. The signaling device 150 also includes a speaker 160 for receiving audible alarms and communications from the monitoring device 120. A light 162 is provided for presenting a visual beacon for location of the signaling device 150. As with the monitoring device 120, the signaling device 150 may be equipped with a tactile alarm system, including a vibration unit located inside the signaling device 150 for presenting a vibratory tactile sensation to wearer of the signaling device. The signaling device 150 also includes an identification number 166 and an Internet web site address 164 for obtaining information about the monitored object to which the signaling device 150 is attached. A GPS satellite system 110 is illustrated for providing precise location information to the monitoring device 120 and the signaling device 150. Operation of GPS satellite constellations is well known to those skilled in the art. Other well-known and acceptable systems for locating the monitoring device 120 and the signaling device 150 may be used, such as ground-based location systems, such as LORAN-C.

An RF signal 170 is illustrated as an alternative location means and communication means between the monitoring device 120 and the signaling device 150. An RF signal transmitted between the monitoring device 120 and the signaling device 150 may be set with a specified signal strength such that an alarm at the monitoring device may be activated if the signaling device is moved beyond the range of the RF signal 170.

A wireless telecommunications system 180 and wireless telecommunications antenna 182 are illustrated in FIG. 1 for providing wireless communications between the signaling device 150 and the monitoring device 120. According to a preferred embodiment, the precise location of the signaling device 150 relative to the location of the monitoring device 120 and all other signaling such as alarm signals, voice communications and instant messaging, are transmitted between the signaling device 150 and the monitoring device 120 via the wireless telecommunication system 180.

According to an embodiment of the present invention, the guardian of the monitored object activates the GPS receivers 122, 152 of the monitoring device and signaling device to establish the precise GPS-based locations of the monitoring device and signaling device. The guardian enters the monitoring perimeter distance, for example, a radius of 50 meters from the monitoring device in which the guardian wishes to monitor the location of the monitored object. The signaling device 150 is then attached to the monitored object. For example, the signaling device may be in the form of a wrist bracelet placed about the wrist of a child or elderly person. The signaling device may be in the form of a collar for attachment to a pet, or the signaling device may be adhered to or placed inside a valuable object such as a purse or briefcase. If desired, the signaling device 150 may be crafted into an aesthetically pleasing shape or form, such as a pendant or other jewelry-like device.

After the GPS receivers 122 and 152 are activated, the monitored object with attached signaling device 150 may roam away from the location of the monitoring device 120. While the signaling device 150 is traveling from the location of the monitoring device 120, the GPS-based coordinates of the signaling device 150 are continuously received by the GPS receiver 152 of the signaling device.

As should be understood by those skilled in the art, the GPS-based coordinates of the signaling device 150 may be received in a well-known coordinate system such as latitude/longitude. As the GPS-based coordinates of the signaling device are received, the processor 154 places the location coordinates in a proper message format for transmission to the monitoring device 120 by the wireless transceiver 158.

The wireless transceiver 158 sends a wireless telecommunications signal to the monitoring device 120 via the wireless telecommunications system 180 and antenna 182. After the wireless transceiver 130 of the monitoring device 120 receives the coordinates of the signaling device 150, the processor 124 of the monitoring device compares the present coordinates of the signaling device 150 with the present coordinates of the monitoring device 120 as received via the GPS receiver 122 of the monitoring device 120. As is understood by those skilled in the art, the processor 124 may determine the linear distance between the signaling device 150 and the monitoring device 120 given the precise location coordinates of the signaling device and the monitoring device.

The distance between the signaling device and the monitoring device as calculated by the processor, is displayed to the guardian on the display 132 of the monitoring device. For example, if the monitored object and signaling device 150 have moved a distance of 20 meters from the monitoring device, a distance of 20 meters will be displayed on the display 132 of the monitoring device 120. Accordingly, the guardian may quickly see that the monitored object has moved a distance of 20 meters away from the guardian. As should be understood, the guardian may move the monitoring device relative to the signaling device, and the relative distance between the monitoring device and the signaling device will be continuously calculated, as described above. That is, neither the monitoring device nor the signaling device must be placed at a stationary location in order to receive the relative distance between the two devices, as described above.

As an alternative embodiment of the present invention, RF transceivers 128 and 156 may be used to locate the signaling device relative to the monitoring device and for activating an alarm if the signaling device travels or is moved beyond a specified monitoring distance. As should be understood by those skilled in the art, the RF signal 170 may be set such that its signal strength allows communication between the monitoring device and the signaling device up to a specified distance. For example, the signal strength of the RF signal may be such that the signal strength becomes too weak for communication between the signaling device 150 and the monitoring device 120 after the distance between the two devices exceeds 50 meters. According to this embodiment, if the RF signal between the two devices is lost, an alarm at the monitoring device may be immediately activated to indicate that the signaling device has traveled or has moved outside the signal range of the RE transceivers 128, 156.

According to the preferred embodiment, once the signaling device 150 is removed from the monitored perimeter, a variety of alarms may be provided to the guardian at the monitoring device 120. A visual alarm may be provided on the display 132, such as "alarm—the monitored object has exceeded the alarm perimeter." Likewise, an audible alarm such as a high-pitched sound may be projected to the guardian via the speaker 134.

The signaling device 150 likewise may include alarms according to the present invention. A light 162 is provided that may be activated when an alarm is presented at the monitoring device. If the perimeter monitoring alarm system of the present invention is being used during evening hours, the light 162 will assist the guardian in locating the monitored object by observing a flashing or solid light emitted from the light 162. Additionally, a speaker 160 is provided at the signaling device 150 for presenting an alarm sound at the signaling device 150. The alarm presented over the speaker 160 may assist the guardian in locating the signaling device and monitored object, or the alarm presented over the speaker 160 may cause the monitored object such as a person to realize that she has traveled beyond the distance prescribed by her guardian. Additionally, the alarm presented via the speaker 160 may be used to cause a would-be thief of the monitored object to cease his disturbance of the monitored object. According to one embodiment, the guardian may activate an alarm at the signaling device 150 via the speaker 160 or the light 162 by depressing the alarm button 131 to send a signal to the signaling device 150, as described above.

The monitoring device 120 and the signaling device 150 may be equipped for voice communications between the two devices via the wireless telecommunications system 180. That is, the monitoring device 120 and the signaling device 150 may send and receive voice communications via the wireless transceivers 130, 158. If the signaling device 150 is removed from the monitored perimeter, the guardian may transmit a voice communication such as "you are going too far, please come back." Likewise, if the monitored object is lost, a finder of the monitored object may activate the wireless transceiver 158 of the signaling device 150 to call the monitoring device 120 to alert the guardian of the location of the monitored object. According to an embodiment of the present invention, each of the monitoring device 120 and the signaling device 150 will contain a preset wireless telephone directory number such that selection of the wireless transceiver 130 automatically places a call to the signaling device 150, and the selection of the signaling transceiver 158 automatically places a wireless telephone call to the monitoring device 120.

According to one embodiment, the street address of the monitored object may be determined based on the GPS-based coordinates of the signaling device 150. The latitude/longitude coordinates of the signaling device 150 may be displayed on the display 132 of the monitoring device 120. The processor 124 may apply the coordinates of the signaling device 150 to a mapping program stored in the memory 126 of the monitoring device to receive a street address for the signaling device 150 so that the guardian of the monitored object may locate a missing monitored object.

Figure 2:
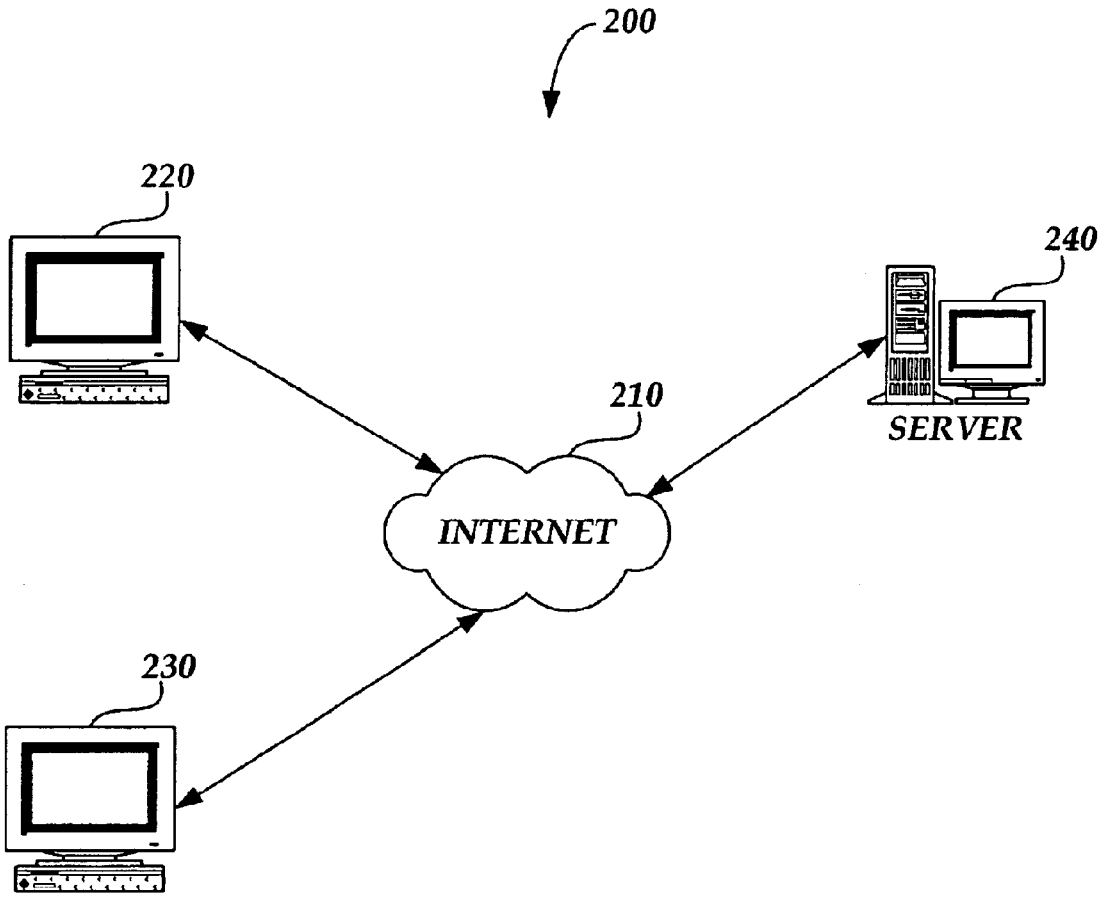
FIG. 2 is a simplified block diagram illustrating some of the components of a distributed computing system that provides an exemplary operating environment for the present invention.

Referring now to FIG. 2, a distributed computing environment 200 is illustrated providing an environment for an embodiment of the present invention. According to the present invention, the provider of the perimeter monitoring alarm system may set up a server 240 for access by users of the system from their individual personal computers 220, 230 via the Internet 210. A user of the perimeter monitoring alarm system may enter an Internet-based web site maintained at the server 240 and provide identification information for the monitored object to which the signaling device 150 is attached. For example, the user may provide the home address, telephone number, and physical characteristics of the monitored object such as height, weight, and hair coloring of a person, or a description of a pet or inanimate object.

As illustrated in FIG. 1, the signaling device 150 includes an Internet web site address 164 for the perimeter monitoring alarm service provider and an identification number 166 for the signaling device 150. If the guardian is unable to locate the monitored object after receipt of the alarms or communications between the signaling device and the monitoring device, described above, a finder of the monitored object may utilize the Internet web site address and identification number to obtain identification information for the monitored object. For example, if a child wearing the signaling device 150 is lost from her parent, a police officer or other person locating the child may enter the Internet-based web site of the perimeter monitoring alarm service provider at the server 240 via the computer 230. The finder of the monitored object then may enter the identification number 166 included on the signaling device 150 and retrieve identification information on the lost child or other monitored object. Subsequently, the finder of the lost monitored object may contact the guardian of the monitored object in order to facilitate return of the monitored object to the guardian.

OPERATION OF AN EXEMPLARY EMBODIMENT

Figure 3:
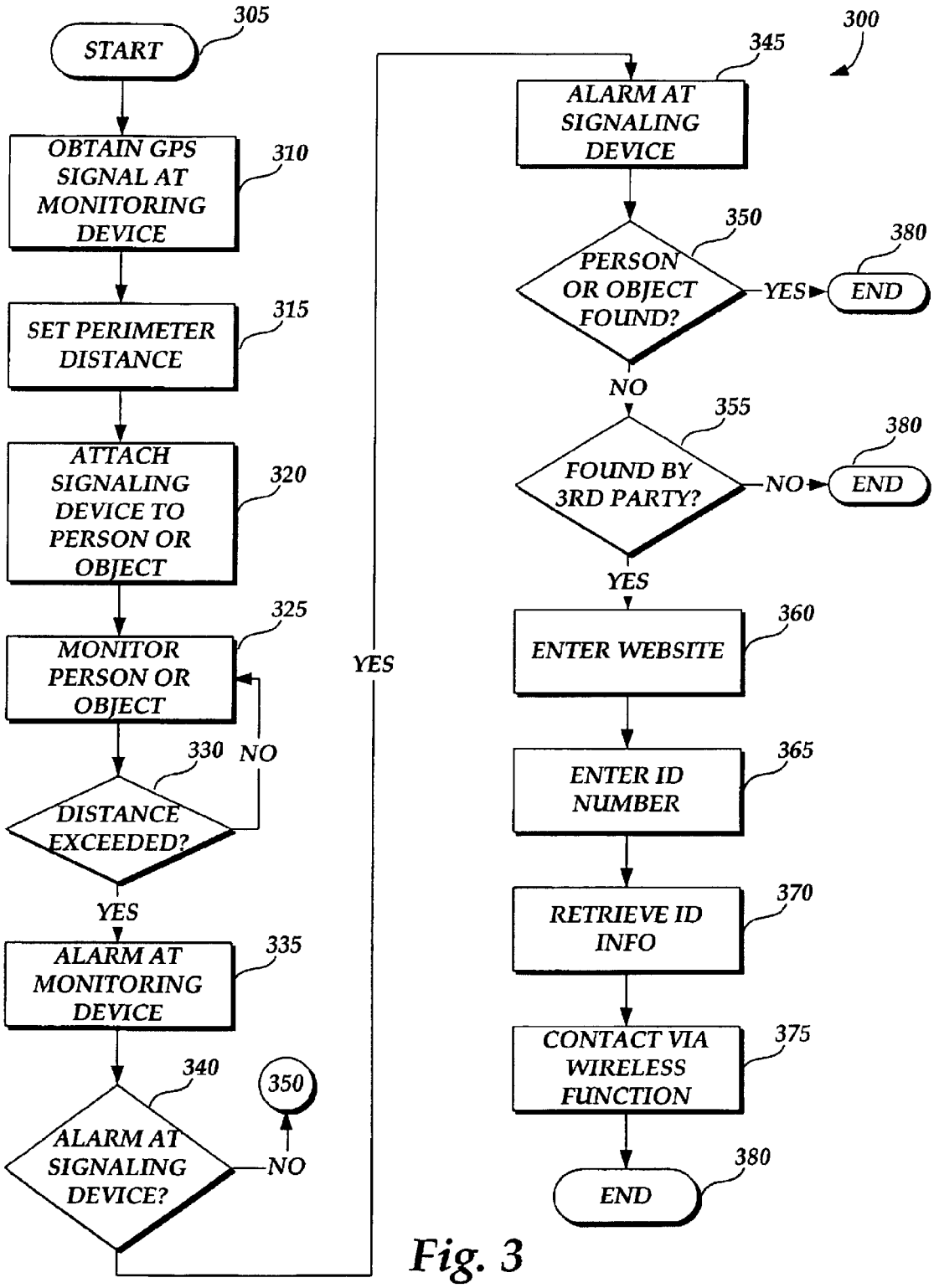
FIG. 3 illustrates operational flow of the steps performed by a system and method of the present invention for monitoring the location of a person, pet, or object in accordance with the present invention.

Having described an exemplary system architecture and operating environment for the present invention, with reference to FIGS. 1 and 2, FIG. 3 illustrates operational flow of the steps performed by a system and method of the present invention for monitoring the location of a person, pet, or object in accordance with the present invention. For purposes of description of FIG. 3, an exemplary monitoring of a monitored object within a specified monitoring area is described. As should be understood, the following example is used for description purposes only and does not restrict or limit the claimed invention.

The method 300 begins at step 305 and proceeds to step 310 where the guardian of a small child activates the signaling device 150 and the monitoring device 120 and obtains GPS signaling from the GPS satellite system 110 in order to establish the precise locations of the signaling device 150 and the monitoring device 120. At step 315, the guardian enters a perimeter monitoring distance to monitor the child's location relative to the guardian. For example, the guardian enters a perimeter monitoring distance of 50 meters using the keypad 136 and the display 132. At step 320, the guardian attaches the signaling device 150 to the child for monitoring the location of the child according to the present invention. At step 325, the guardian allows the child to play away from the guardian, and the guardian commences monitoring the child using the system of the present invention.

As described above, the distance between the child wearing the signaling device 150 and the monitoring device maintained by the guardian is continuously monitored by comparing the GPS-based coordinates of the signaling device 150 with the GPS-based coordinates of the monitoring device 120. Accordingly, the distance between the signaling device 150 worn by the child and the monitoring device 120 maintained by the guardian is continuously updated and is displayed on the display 132 of the monitoring device 120.

At step 330, a determination is made as to whether the distance set by the guardian, for example 50 meters, has been exceeded. If not, the method returns back to step 325 and monitoring continues. If the perimeter distance has been exceeded, the method proceeds to step 335 and an alarm is presented at the monitoring device 120. As described above, the alarm may take the form of a visual display at the display 132, an audible alarm presented via the speaker 134, a visual light at the device 150, a tactile alarm sensed by the guardian, or a combination thereof. Once the guardian receives the alarm, the guardian may call out to the child to require the child to return back within the prescribed monitoring distance. Alternatively, the guardian may select the wireless transceiver 130 to initiate a wireless telecommunications call between the monitoring device 120 and the signaling device 150 in order to communicate over the speaker 160 to the child to direct the child to return back to the prescribed monitoring perimeter.

At step 340, a determination is made as to whether an alarm is to be presented at the signaling device 150. If not, the method proceeds to step 350. If yes, at step 345, an alarm is presented at the signaling device 150 via the speaker 160, via the light 162, via a tactile alarm, or via a combination thereof, as described above. As should be understood, there will be times when it is advantageous to present an alarm at the signaling device, such as when the monitored object has been lost during evening hours. On the other hand, if the monitored object has been taken from the guardian, such as by a thief, it may be determined that presentation of an alarm that will be heard or seen by the thief is not advantageous. According to a preferred embodiment of the present invention, an alarm activated at the signaling device 150 is initiated by the guardian from the monitoring device 120 by depressing the alarm button 131.

At step 350, a determination is made as to whether the monitored object has been found by the guardian. If yes, the method ends at step 380. If the monitored object has not been found, the method proceeds to step 355 and a determination is made as to whether the monitored object has been found by a third party. If not, the method ends at step 380. As should be understood, if the monitored object has not been found by the guardian or by an appropriate third person, the guardian may, of course, exhaust all available resources for locating the monitored object.

If the monitored object has been found by a third party at step 355, the method proceeds to step 360, and the third party, such as a police officer or other citizen, may retrieve the signaling device 150 from the monitored object and obtain the Internet web site address 164 and identification number 166 from the signaling device 160. The third party then may enter the web site of the perimeter monitoring alarm service provider at the server 240 via the computer 230 and the Internet 210 to obtain information on the found monitored object. At step 365, the third party enters the identification number 166 from the signaling device 150, and at step 370, the third party retrieves identification information on the found monitored object. For example, according to the present example, the third party may receive identifying physical characteristics of the missing child, such as height, weight, hair color, eye color, etc. The third party may retrieve the home address, and telephone number of the missing child's guardian for return of the missing child to the guardian.

At step 375, if the monitoring device 120 and signaling device 150 are equipped with wireless transceivers 130 and 158 as described above, the third party may determine from the information provided via the web site of the perimeter monitoring alarm service provider that the guardian may be contacted by wireless communication between the signaling device 150 and the monitoring device 120. Accordingly, the third party may select the wireless transceiver 158 to initiate a direct wireless telephone call to the guardian at the monitoring device 120. The method then ends at step 380.

As described herein, a system and method are provided for monitoring the distance and location of a person, animal, or object from the location of a designated monitoring device. It will be appreciated by those skilled in the art that various modifications or variations may be made in the present invention without departing from the scope or spirit of the invention. Other embodiments of the invention will be apparent to those skilled in the art from consideration of the specification and practice of the invention disclosed herein.

We claim:

1. A method of monitoring the movement of an object relative to a monitoring perimeter, comprising the steps of:

obtaining a location of a monitoring device;

obtaining a first location of a signaling device;

at the monitoring device, setting a monitoring perimeter distance;

attaching the signaling device to a monitored object;

obtaining a second location of the signaling device;

sending the second location to the monitoring device;

at the monitoring device, comparing the second location of the signaling device with the location of the monitoring device;

determining whether a distance between the signaling device and the monitoring device is greater than the monitoring perimeter distance;

if the distance between the signaling device and the monitoring device is greater than the monitoring perimeter distance, presenting an alarm at the monitoring device; and at the monitoring device, placing a telephone call via a wireless telecommunications system to the signaling device to transmit a voice communication to the signaling device.

2. The method of claim 1, whereby the steps of obtaining a location of a monitoring device and obtaining a first location of a signaling device include receiving location data from a global positioning satellite system at each of the monitoring device and the signaling device.

3. The method of claim 1, wherein the monitored object is a person.

4. The method of claim 1, wherein the monitored object is an animal.

5. The method of claim 1, wherein the monitored object is an inanimate object.

6. The method of claim 1, whereby the step of sending the second location to the monitoring device includes the step of:

sending data representing the second location to the monitoring device via a wireless telecommunications system.

7. The method of claim 1, prior to the step of determining whether the distance between the signaling device and the monitoring device is greater than the monitoring perimeter distance, including the step of:

at the monitoring device, processing the second location of the signaling device and the location of the monitoring device to determine the linear distance between the signaling device and the monitoring device.

8. The method of claim 1, whereby the step of presenting an alarm at the monitoring device includes the step of:

displaying a visual alarm at the monitoring device.

9. The method of claim 1, whereby the step of presenting an alarm at the monitoring device includes:

presenting an audible alarm at the monitoring device.

10. The method of claim 1, whereby the step of presenting an alarm at the monitoring device includes:

presenting a tactile alarm at the monitoring device.

11. The method of claim 1, further comprising the step of:

if the distance between the signaling device and the monitoring device is greater than the monitoring perimeter distance, presenting an alarm at the signaling device.

12. The method of claim 11, whereby the step of presenting an alarm at the signaling device includes depressing an alarm button at the monitoring device.

13. The method of claim 11, whereby the step of presenting an alarm at the signaling device includes displaying a visual alarm at the signaling device.

14. The method of claim 11, whereby the step of presenting an alarm at the signaling device includes the step of presenting an audible alarm at the signaling device.

15. The method of claim 11, whereby the step of presenting an alarm at the signaling device includes the step of presenting a tactile alarm at the signaling device.

16. The method of claim 1, further comprising the steps of:

connecting to an information server via a distributed computing network;

obtaining an identification number from the signaling device;

entering the identification number into the information server; and retrieving identification information for the monitored object from the information server.

17. The method of claim 1, further comprising the step of:

at the signaling device, placing a telephone call via the wireless telecommunications system to the monitoring device to transmit a voice communication to the monitoring device.

18. The method of claim 1, further comprising the steps of:

determining a representative location for the second location of the signaling device based on the second location of the signaling device; and displaying the representative location at the monitoring device.

19. The method of claim 1, wherein placing a telephone call to the signaling device includes selecting a preset wireless telephone directory number to automatically place the telephone call to the signaling device.

20. The method of claim 18, wherein the representative location for the second location of the signaling device is a street address.

21. A method of monitoring the movement of an object relative to a monitoring perimeter, comprising the steps of:

establishing a radio frequency signal between a monitoring device and a signaling device;

at the monitoring device, setting a monitoring perimeter distance;

attaching the signaling device to the monitored object;

determining whether the distance between the signaling device and the monitoring device is greater than the monitoring perimeter distance;

if the distance between the signaling device and the monitoring device is greater than the monitoring perimeter distance, presenting an alarm at the monitoring device; and at the monitoring device, placing a telephone call via a telecommunications system to the signaling device to transmit a voice communication to the signaling device.

22. The method of claim 21, wherein the step of determining whether the distance between the signaling device and the monitoring device is greater than the monitoring perimeter distance includes the step of:

determining that the signal strength of the radio frequency signal between the monitoring device and the signaling device is less than a minimum signal strength required for communication between the monitoring device and the signaling device at the monitoring perimeter distance.

23. The method of claim 21, further comprising the step of:

at the signaling device, placing a telephone call to the monitoring device to transmit a voice communication to the monitoring device.

24. A system for monitoring the movement of an object relative to a monitoring perimeter, comprising the steps of:

a monitoring device operative to obtain a location of the monitoring device;

to obtain a first location of a signaling device;

to set a monitoring perimeter distance;

to obtain a second location of the signaling device;

the signaling device operative for attachment to a monitored object;

to send the second location to the monitoring device;

the monitoring device further operative to compare the second location of the signaling device with the location of the monitoring device;

to determine whether a distance between the signaling device and the monitoring device is greater than the monitoring perimeter distance;

to present an alarm at the monitoring device if the distance between the signaling device and the monitoring device is greater than the monitoring perimeter distance;

to place a telephone call via a wireless telecommunications system to the signaling device to transmit a voice communication to the signaling device.

25. The system of claim 24, whereby the monitoring device is further operative to obtain a location of a monitoring device and to obtain a first location of a signaling device by receiving location data from a global positioning satellite system at each of the monitoring device and the signaling device.

26. The system of claim 24, whereby the monitored object is a person.

27. The system of claim 24, whereby the monitored object is an animal.

28. The system of claim 24, whereby the monitored object is an inanimate object.

29. The system of claim 24, whereby the signaling device is further operative to place a telephone call via a wireless telecommunications system to the monitoring device to transmit a voice communication to the monitoring device.

30. The system of claim 24, whereby the monitoring device is further operative to process the second location of the signaling device and the location of the monitoring device to determine the linear distance between the signaling device and the monitoring device.

31. The system of claim 24, whereby the monitoring device is further operative to present an alarm by displaying a visual alarm at the monitoring device.

32. The system of claim 24, whereby the monitoring device is further operative to present an alarm by displaying an audible alarm at the monitoring device.

33. The system of claim 24, whereby the monitoring device is further operative to present an alarm by displaying a tactile alarm at the monitoring device.

34. The system of claim 24, whereby the monitoring device is further operative to present an alarm at the signaling device if the distance between the signaling device and the monitoring device is greater than the monitoring perimeter distance.

35. The system of claim 34, whereby the signaling device is further operative to present an alarm by displaying a visual alarm at the signaling device.

36. The system of claim 34, whereby the signaling device is further operative to present an alarm by displaying an audible alarm at the signaling device.

37. The system of claim 34, whereby the signaling device is further operative to present an alarm by presenting a tactile alarm at the signaling device.

38. The system of claim 24, whereby the monitoring device is further operative to determine a street address for the second location of the signaling device; and to display the street address at the monitoring device.

* * * * *